United States Patent [19]

Haraguchi et al.

[11] Patent Number: 5,003,955

[45] Date of Patent: Apr. 2, 1991

[54] METHOD OF CONTROLLING AIR-FUEL RATIO

[75] Inventors: Hiroshi Haraguchi, Kariya, Japan; Hiroshi Tamura, Torrance, Calif.; Katuhiko Kodama, Obu; Toshio Kondo, Kariya, both of Japan

[73] Assignee: Nippondenso Co., Ltd., Kariya, Japan

[21] Appl. No.: 463,438

[22] Filed: Jan. 11, 1990

[30] Foreign Application Priority Data

Jan. 20, 1989 [JP] Japan ..... 1-012529

[51] Int. Cl.[5] ..... F02D 41/14

[52] U.S. Cl. ..... 123/489; 123/440

[58] Field of Search ..... 123/489, 440, 435; 364/431.05

[56] References Cited

U.S. PATENT DOCUMENTS

| | | | |
|---|---|---|---|
| 4,616,619 | 10/1986 | Saito | 123/489 |
| 4,625,699 | 12/1986 | Kobayashi | 123/489 |
| 4,627,404 | 12/1986 | Saito | 123/440 |
| 4,633,840 | 1/1987 | Saito | 123/489 |
| 4,669,439 | 6/1987 | Mamiya | 123/489 |
| 4,671,243 | 6/1987 | Deutsch | 123/489 |
| 4,707,985 | 11/1987 | Nagai | 123/489 |
| 4,715,344 | 12/1987 | Tomisawa | 123/489 |
| 4,815,435 | 3/1989 | Leveure | 123/489 |
| 4,858,581 | 8/1989 | Hoshi | 123/489 |
| 4,924,836 | 5/1990 | Uchida | 123/489 |

FOREIGN PATENT DOCUMENTS 57-18440 1/1982 Japan .

*Primary Examiner*—Carl Stuart Miller

*Attorney, Agent, or Firm*—Cushman, Darby & Cushman

[57] ABSTRACT

A method of controlling the air fuel ratio in internal combustion, engines, comprising the steps of: updating first learning terms at a first learning speed in response to a signal from the air-fuel-ratio sensor and respectively storing them in a reloadable memory device, the first learning terms being provided for respective different ranges corresponding to different engine temperature and related to factors causing variation in air-fuel ratio in such a manner that the air-fuel-ratio variate of the variation varies depending upon the engine temperature; updating second learning terms at a second learning speed which is higher than the first learning speed in response to a signal from the air-fuel-ratio sensor and storing them in the reloadable memory device, the second learning terms being related to factors causing variation in air-fuel ratio in such a manner that the air-fuel-ratio variate of the variation varies in a substantially uniform manner with respect to the engine temperature; and determining the transient learning value on the basis of the first learning terms dependent on the engine temperature and stored in the memory device and of the second learning terms stored in the memory device, and correcting the transient correction value in accordance with the transient learning value thus determined.

9 Claims, 13 Drawing Sheets

METHOD OF CONTROLLING AIR-FUEL RATIO

BACKGROUND OF THE INVENTION

This invention relates to a method of controlling the air-fuel ratio in internal combustion engines, and in particular, to a method which makes it possible to adjust the air-fuel ratio close to a theoretical air-fuel ratio with accuracy even under a transient state such as acceleration and deceleration.

A method of adjusting the air-fuel ratio in internal combustion engines as close as possible to a theoretical air-fuel ratio has been proposed in U.S. Pat. No. 4,616,619. According to this method, the fluctuation of a signal supplied from an air-fuel-ratio sensor when the engine is being accelerated is monitored to measure the deviation of the actual air-fuel ratio from a theoretical ratio, and an acceleration fuel-increment coefficient or a deceleration fuel-decrement coefficient is learned in such a manner that this deviation becomes zero.

However, the above method has the following problem: depending upon the type of factor causing variation in the transient air-fuel ratio, it may sometimes be difficult for a transient air-fuel ratio to be adjusted to the theoretical ratio over the entire engine-warm-up range. According to the result of an experiment conducted by the inventors of the present invention, the manner of variation in a transient air-fuel ratio under different engine-temperature conditions (e.g., different engine coolant temperatures) greatly varies depending upon the type of factor causing the variation (which may, for example, be deposit around the intake valve or the properties of the gasoline used).

In the case where valve deposit constitutes the factor, the air-fuel ratio varies to a large degree as the temperature of the coolant changes. In the case where the gasoline properties constitute the factor, the air-fuel ratio does not vary so much with the temperature of the coolant. This fact indicates that the degree of dependence of the variation in air-fuel ratio upon the temperature of the coolant is completely different for different factors causing the variation.

Thus, with the above-described conventional method, which does provide for discrimination of one type of factor from the other, the air-fuel ratio cannot be adjusted to the theoretical ratio over the entire temperature range of the coolant.

This problem may be solved by establishing different learning values for different temperature ranges of the coolant. With such a system, however, the learning cannot be conducted satisfactorily on the lower-temperature side, so that a problem arises with respect to the learning speed. That is, since the temperature of the coolant is raised too soon during the engine warm-up period, there is scarcely any chance for the learning to be conducted on the lower-temperature side. Thus, the above problem cannot be solved by simply establishing different learning values for different temperature ranges of the coolant, since the learning is not then effected satisfactorily on the lower-temperature side, resulting in an excessive deviation from the theoretical air-fuel ratio.

SUMMARY OF THE INVENTION

It is accordingly the object of this invention to provide a method of controlling air-fuel ratio which allows air-fuel ratio to be controlled in different manners in accordance with the type of air-fuel-ratio-variation causing factor, thereby making it possible to control a transient air-fuel ratio with accuracy over the entire engine temperature range.

In order to attain the above object, this invention provides a method of controlling the air fuel ratio in internal combustion engines of the type in which a transient correction value for correcting a base fuel quantity in an internal combustion engine in a transient state is corrected in accordance with a transient learning value determined on the basis of a signal supplied from an air-fuel-ratio sensor when the engine is in a transient state, thereby accurately adjusting the air-fuel ratio of a mixture supplied to the engine in a transient state to a target air-fuel ratio, the method comprising the steps of:

updating first learning terms at a first learning speed in response to a signal from the air-fuel-ratio sensor and respectively storing them in a reloadable memory device, the first learning terms being provided for respective different ranges corresponding to different engine temperatures and related to factors causing variation in air-fuel ratio in such a manner that the air-fuel-ratio variate varies depending upon the engine temperature;

updating second learning terms at a second learning speed which is higher than the first learning speed in response to a signal from the air-fuel-ratio sensor and storing them in the reloadable memory device, the second learning terms being related to factors causing variation in air-fuel ratio in such a manner that the air-fuel-ratio variate varies in a substantially uniform manner with respect to the engine temperature; and determining the transient learning value on the basis of the first learning terms dependent upon the engine temperature and stored in the memory device and of the second learning terms stored in the memory device, and correcting the transient correction value in accordance with the transient learning value thus determined.

DESCRIPTION OF THE PREFERRED EMBODIMENT

As stated above, the manner of variation in a transient-state air-fuel ratio under different engine-temperature conditions (e.g., different engine coolant temperatures) varies to a large degree depending on the type of factor causing the variation (e.g., the amount of deposit around the intake valve or the properties of the gasoline used). This is shown in the experiment results given in FIGS. 17A and 17B.

Figure 17A:
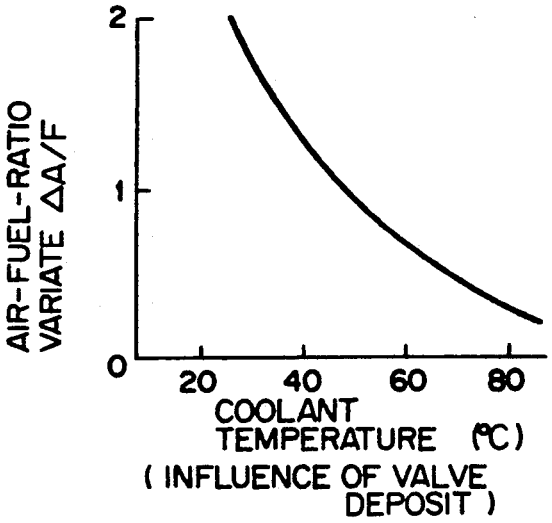
FIG. 17A is a characteristic diagram showing the relationship between the air-fuel-ratio variate and the coolant temperature when there exists some deposit around the intake valve.
Figure 17B:
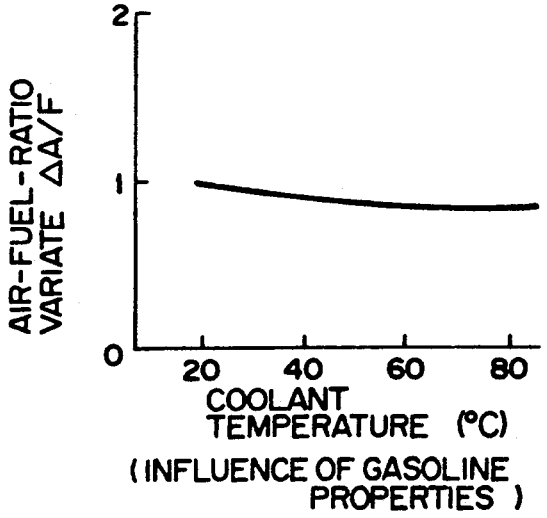
FIG. 17B is a characteristic diagram showing the relationship between the air-fuel-ratio variate and the coolant temperature when a gasoline with poor volatility is used.

FIG. 17A shows the air-fuel-ratio variate $\Delta A/F$ (the peak air-fuel-ratio difference) under an accelerating condition with respect to the coolant temperature when there exists some deposit around the engine intake valve on which fuel injected through the fuel-injection valve splashes. This variate was examined regarding the case where no deposit exists around the intake valve as the reference. FIG. 17B shows the acceleration air-fuel-ratio variate $\Delta A/F$ with respect to the coolant temperature when a gasoline with poor volatility is used as compared to the case where a regular gasoline is used. In the case where the valve deposit constitutes the factor causing variation in air-fuel ratio, the air-fuel-ratio variate $\Delta A/F$ varies greatly as the coolant temperature changes, whereas the difference in the gasoline properties does not cause the air-fuel-ratio variate to vary so much with respect to the coolant temperature. Thus, the dependence of the air-fuel-ratio variate upon the coolant temperature varies to a large degree depending upon the type of factor causing the variation.

The present invention aims at controlling the air-fuel ratio in different manners in accordance with the type of factor causing variation the in air-fuel ratio, thereby making it possible to control a transient-state air-fuel ratio with accuracy over the entire engine-temperature range.

Figure 1:
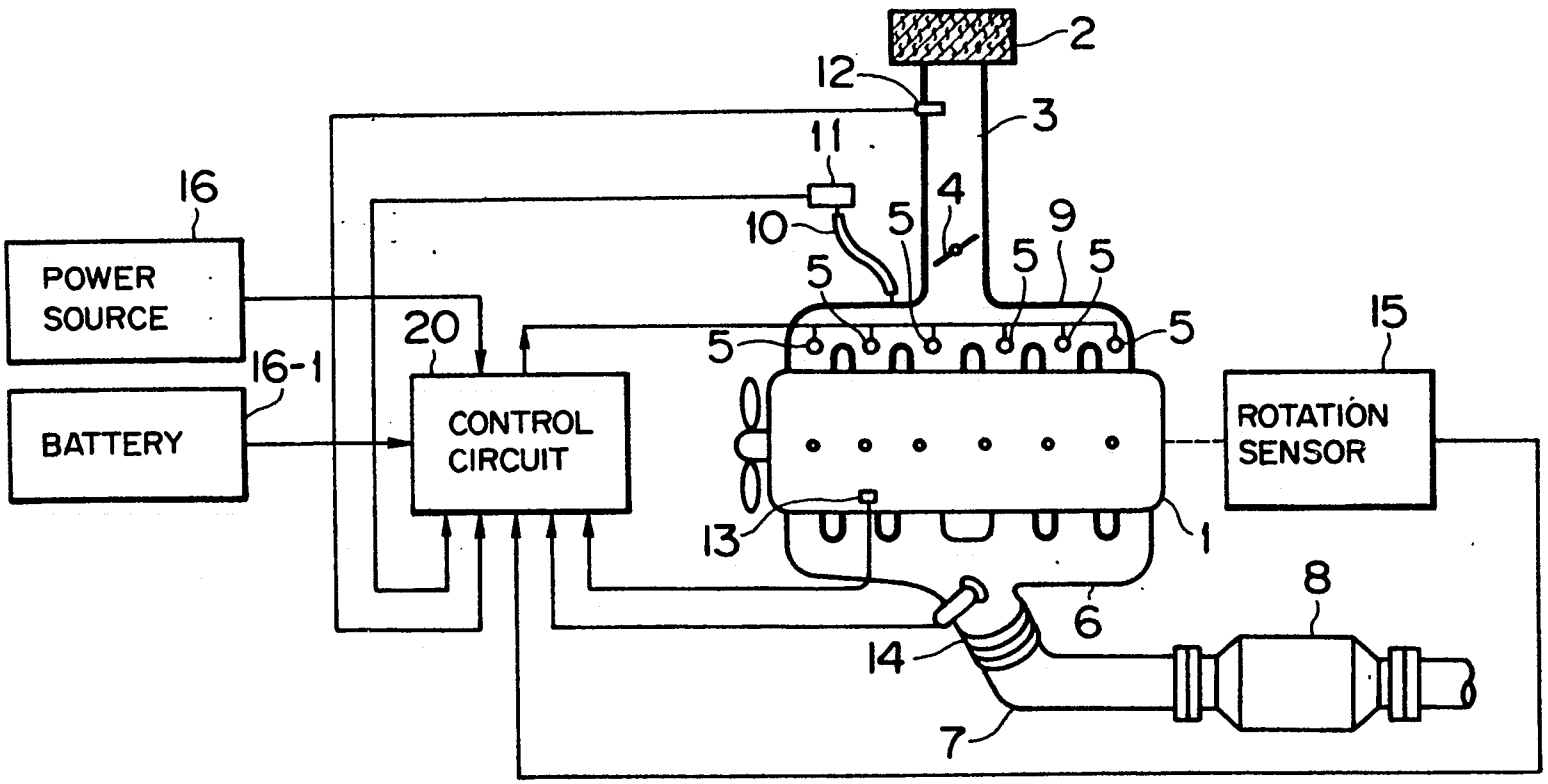
FIG. 1 is a block diagram of an example of the apparatus to which the method of this invention is to be applied.

An embodiment of this invention will now be described with reference to the accompanying drawings. FIG. 1 shows an embodiment of this invention as applied to a well-known 4-cycle spark-ignition internal combustion engine 1 which is to be mounted in an automobile. The engine 1 sucks in air for combustion through an air cleaner 2, an intake-air passage 3, a throttle valve 4, and an intake manifold 9. Fuel is supplied from a fuel system (not shown) through electromagnetic fuel-injection valves 5 provided in correspondence with the cylinders. After combustion, the air is discharged into the atmosphere through an exhaust manifold 6, an exhaust pipe 7, and a three way catalytic converter 8. A pressure sensor 11 for measuring the pressure in the intake manifold 9 is connected to the intake manifold 9 through a duct 10 and generates an output corresponding to the intake-air quantity. Further, a thermistor-type intake-air-temperature sensor 12 is provided which is adapted to output an analog voltage corresponding to the intake-air temperature.

Provided on the engine 1 is a thermistor-type water-temperature sensor 13 adapted to measure the temperature of the coolant and to output an analog voltage corresponding to the temperature of the coolant. Further, provided on the exhaust manifold 6 is an air-fuel-ratio sensor 14 which is adapted to measure the air-fuel ratio on the basis of the oxygen density in the exhaust gas. When the air-fuel ratio measured is smaller than the theoretical air-fuel ratio (rich condition), this air-fuel-ratio sensor 14 outputs a voltage of about 1 volt (high level). When the air-fuel ratio measured is larger than the theoretical air-fuel ratio (lean condition), it outputs a voltage of about 0.1 volt (low level).

A rotation sensor 15 measures the rotating speed of the crank shaft of the engine 1, and outputs a pulse signal with a frequency corresponding to the engine speed. The reference numeral 16 indicates a power source which outputs a D.C. voltage obtained by stabilizing the voltage of a battery 16-1. A control circuit 20 calculates the fuel-injection quantity on the basis of the detection signals supplied from the sensors 11 to 16-1, and adjusts the fuel-injection quantity by controlling the valve-opening time for the electromagnetic fuel-injection valves 5.

FIGS. 2A, 2B, 2C and 2D show the intake manifold pressure P, the difference value of the intake manifold pressure P: $[(P_n-P_{n-1})/(T_n-T_{n-1})]$, the fuel-increment ratio serving as the transient correction value, and the output of the air-fuel-ratio sensor, respectively, of an internal combustion engine under a transient state in which the engine is being accelerated. The horizontal axis represents time.

Figure 2A:
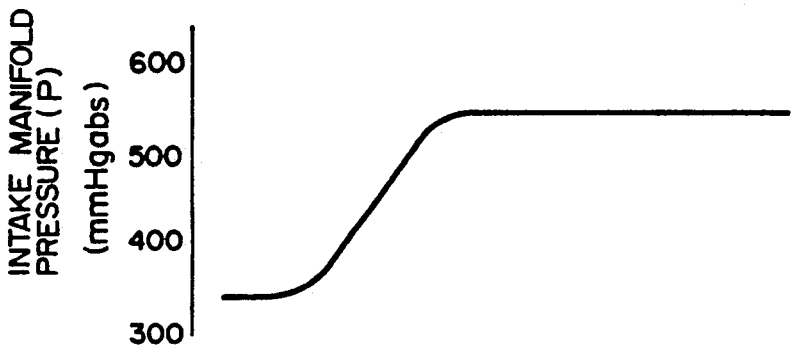
FIGS. 2A, 2B, 2C and 2D are diagrams showing the changes in the intake manifold pressure, the difference value of the intake manifold pressure, the fuel-increment ratio, and the output of the air-fuel-ratio sensor, respectively, of an internal combustion engine under an accelerating condition.
Figure 2B:
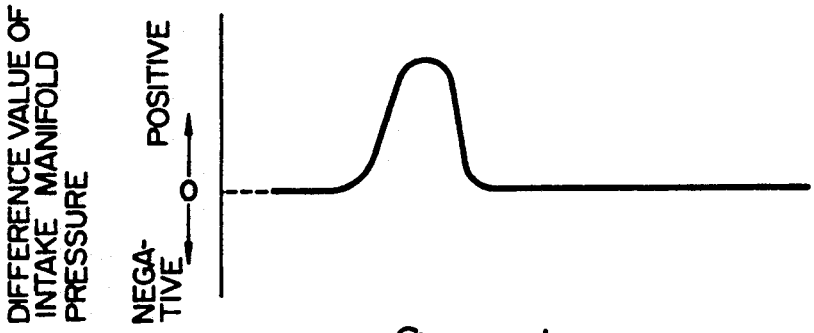
Figure 2C:
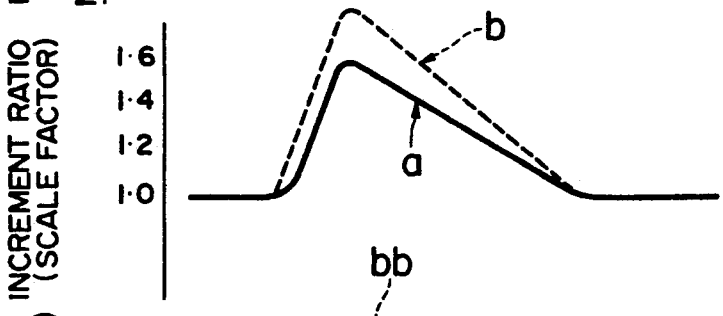
Figure 2D:
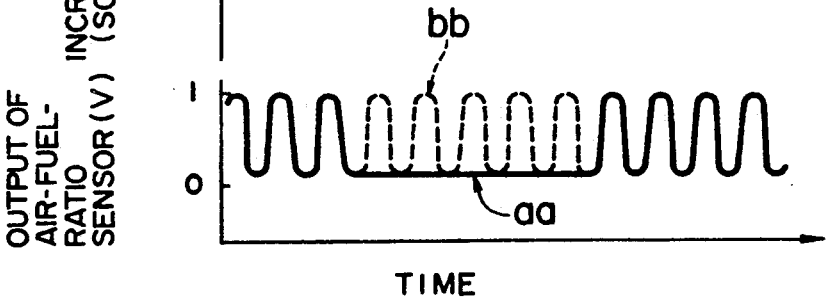

When the difference value of the intake manifold pressure is as shown in FIG. 2B, the characteristic line a of FIG. 2C, representing a relatively low fuel-increment ratio, results in an output from the air-fuel-ratio sensor as represented by the characteristic line aa of FIG. 2D, which indicates a poor increment in fuel quantity. In contrast, when the fuel-increment ratio is as indicated by the characteristic line b of FIG. 2C, the output of the air-fuel-ratio sensor is, as in the steady state, such as can be represented by the characteristic line bb of FIG. 2D, which indicates a condition where the fuel-increment value is well in harmony with the theoretical air-fuel ratio.

This invention aims at controlling the output of the air-fuel-ratio sensor such that it is represented by the characteristic line bb of FIG. 2D for all transient states, i.e., adjusting it to the theoretical air-fuel ratio, thereby making it possible to purify the exhaust gas while keeping the purifying ratio of the three way catalytic converter at an optimum level.

Generally, a fuel increment is needed when accelerating the engine due, for example, to the delay in response of the sensor, whereas, when decelerating the engine, a fuel decrement is needed likewise on account, for example, of the response delay of the sensor. FIGS. 3A, 3B, 3C and 3D show the intake manifold pressure P, the difference value of the intake manifold pressure P: $[(P_n-P_{n-1})/(T_n-T_{n-1})]$, the fuel-decrement ratio serving as the transient correction value, and the output of the air-fuel-ratio sensor, respectively, of an internal combustion engine under a decelerating condition. The horizontal axis represents time.

Figure 3A:
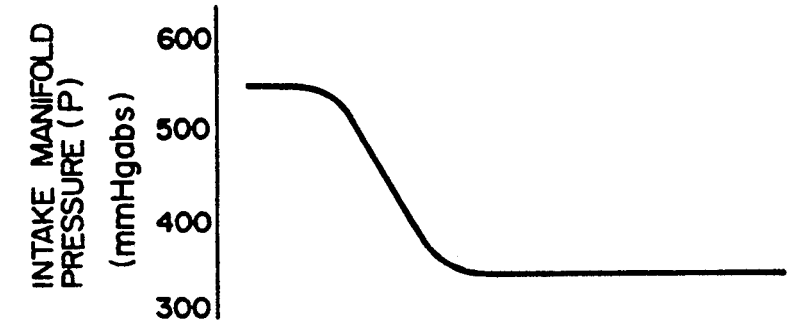
FIGS. 3A, 3B, 3C and 3D are diagrams showing the changes in the intake manifold pressure, the difference value of the intake manifold pressure, the fuel-increment ratio, and the output of the air-fuel-ratio sensor, respectively, of an internal combustion engine under a decelerating condition.
Figure 3B:
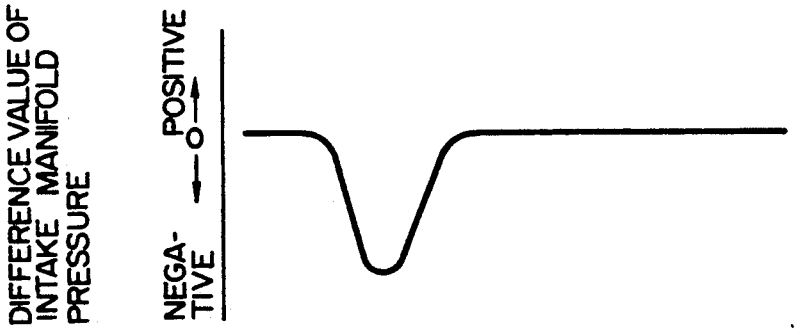
Figure 3C:
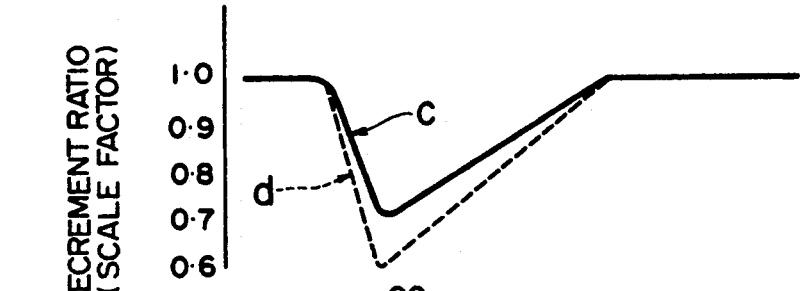
Figure 3D:
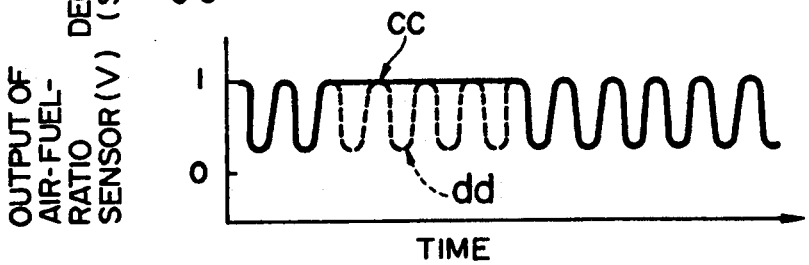

When the fuel-decrement ratio is as indicated by the characteristic line c of FIG. 3C, the output of the air-fuel-ratio sensor is such as is represented by the characteristic line cc of FIG. 3D, which indicates a still insufficient fuel decrement. By further effecting fuel decrement until it is represented by the characteristic line d of FIG. 3C, the output of the air-fuel-ratio sensor becomes such as is represented by the characteristic line dd of FIG. 3D, which indicates a fuel-decrement value well in harmony with the theoretical air-fuel ratio.

Figure 4:
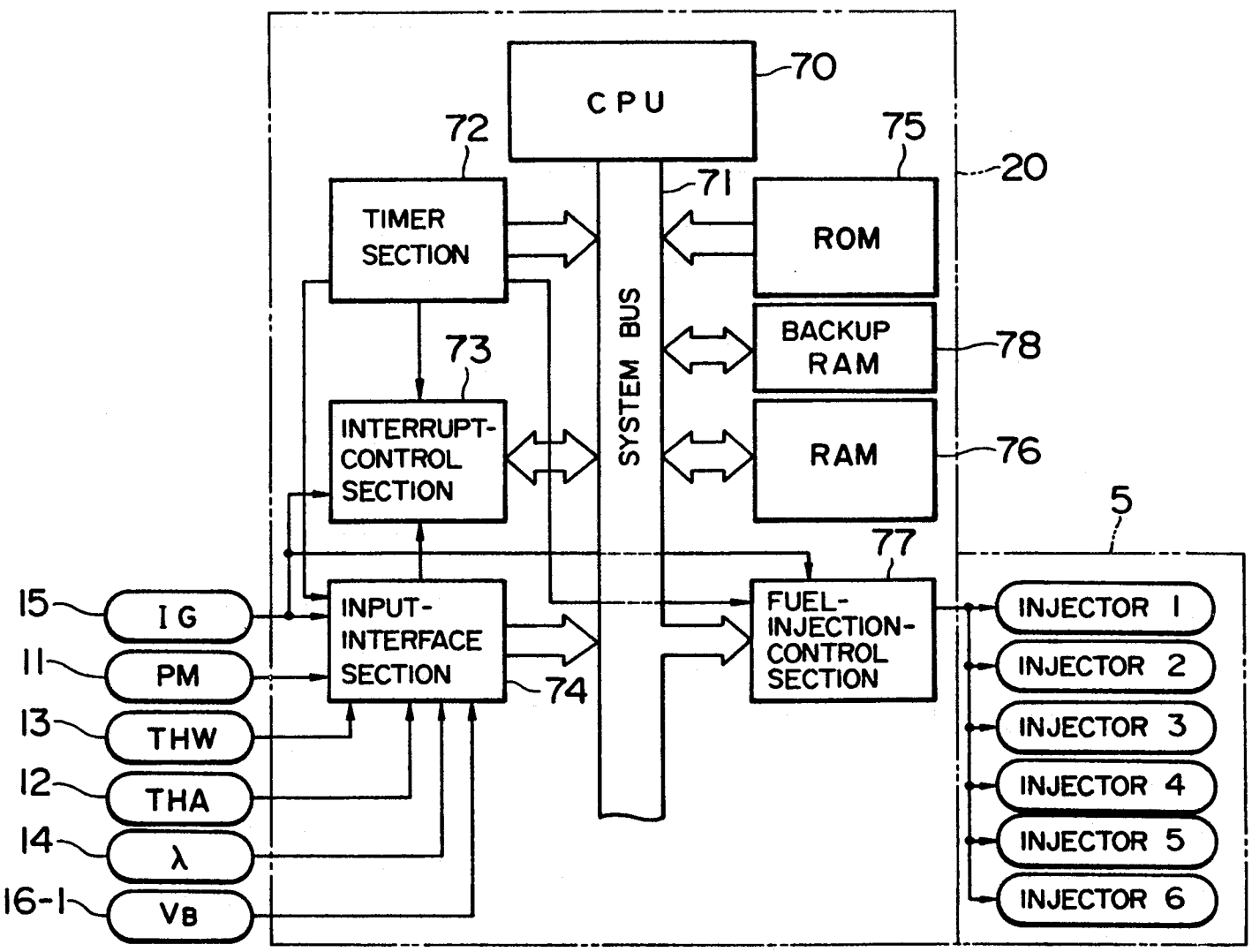
FIG. 4 is a block diagram of the control circuit.

Next, a control circuit 20 will be described in detail with reference to FIG. 4. The reference numeral 70 indicates a central processing unit (CPU) for performing calculating and controlling operations. A microprocessor is employed in this CPU. The reference numeral 71 indicates a system bus which consists of a data bus, an address bus, and a control bus. The CPU 70 supplies through the system bus 71 clock pulses for operating itself and circuit sections 72 to 77. At the same time, it respectively supplies clocks to an interrupt control section 73, an input-interface section 74, and a fuel-injection control section 77.

The interrupt control section 73 is adapted to receive a timer-interrupt-request signal every certain period (about 8 to 50 ms) in accordance with a signal from a timer section 72, and to receive an ignition-interrupt-request signal in accordance with an ignition-pulse signal from the rotation sensor 15. Upon receiving these interrupt-request signals, the interrupt control section 73 resets them. The input-interface section 74 serves to transform the signals from the sensors into a form which can be utilized by the CPU 70; it converts the respective analog signals PM, THA, THW, and $V_B$ from supplied from the pressure sensor 11 for measuring the intake manifold pressure, the intake-air-temperature sensor 12, the coolant temperature sensor 13, and the battery terminals into digital data by means of an A/D converter. Further, the input-interface section 74 determines, from the output of the air-fuel-ratio sensor 14, whether the current air-fuel ratio is greater than the theoretical air-fuel ratio (lean) or smaller than it (rich), and transfers the result to the CPU 70. In addition, the input-interface section 74 stores the data on the distance between adjacent pulses of the ignition-pulse signal from the rotation sensor 15 by means of the clock signal from the timer section 72, and transfers it to the CPU 70, computing the engine speed in the manner described below.

The reference numeral 75 indicates a read-only-memory unit (ROM) adapted to store optimum control data or the like for the programs and the different engine conditions, and the reference numeral 76 indicates a temporary-storage unit (RAM) to be used during program operation. The reference numeral 78 indicates a backup RAM which serves to store a transient correction map even when the engine is at rest and which is backed up through direct application of a constant voltage from the power source 16. The reference numeral 77 indicates a fuel-injection control section which is adapted to transform fuel-injection-time data transferred from the CPU 70 into the width of a valve-opening-time pulse by means of clock pulses supplied by the timer section 72, the valves of the injectors (electromagnetic fuel-injection valves) 5 being held open for a period corresponding to this width.

Thus, the injectors 5, opened by an IG-pulse signal obtained by dividing an ignition pulse into two, are held open for a period corresponding to the injection-time data transferred from the CPU 70. This embodiment adopts the 6-cylinder-synchronized-injection system, the respective injectors of the cylinders being connected in parallel. Upon receipt of the respective input signals from the different sensors through the input-interface section 74 in accordance with the program stored in the ROM 75, the CPU 70 computes the optimum injection quantity in correspondence with the engine condition, and delivers the data thus obtained to the fuel-injection control section 77.

Figure 5:
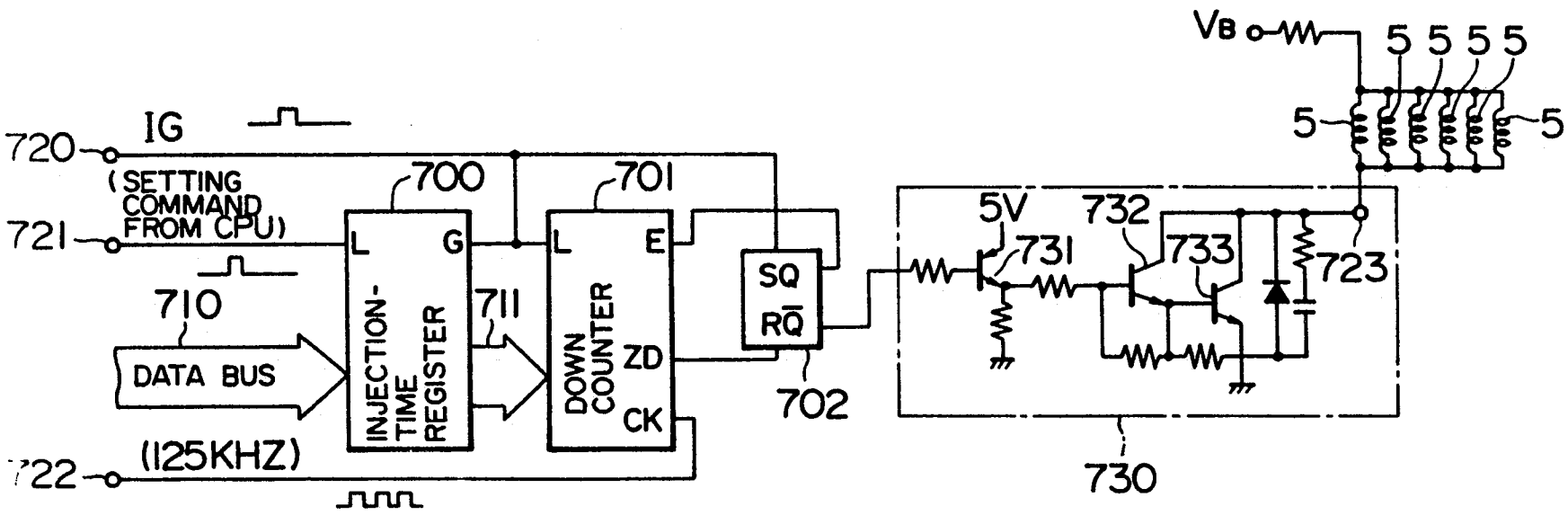
FIG. 5 is a detailed circuit diagram of the fuel-injection controlling section.
Figure 7A:
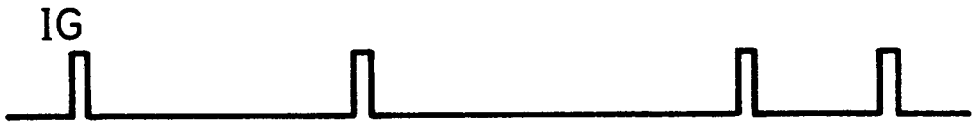
FIGS. 7A and 7B are timing charts illustrating the circuit operation in the fuel-injection controlling section shown in FIG. 5.

FIG. 5 is a detailed circuit diagram of the fuel-injection control section 77. In the following, the operation of this fuel-injection control section 77 will be described with reference to the timing charts of FIGS. 7A and 7B. The reference numeral 710 indicates a data bus which constitutes a component of the system bus 71 shown in FIG. 4. A primary-coil high-voltage pulse which is generated for each ignition by the rotation sensor 15 is waveform-shaped by means of the interface circuit 74 shown in FIG. 4, and is divided into two to yield an ignition (IG) pulses as shown in FIG. 7A. One IG pulse is generated for every two ignitions. These IG pulses are entered through a terminal 720 shown in FIG. 5 into an injection-control flip-flop (I.FF) 702 through the S-terminal thereof, setting the Q-output to "1" (the $\overline{Q}$-output to "0"). At the same time, the IG pulses are applied to the G-germinal of an injection-time register (I.R) 700 and to the L-terminal of a down counter (D.C) 701, injection-time data E previously set in the I.R 700 by the CPU 70 being transferred to the D.C. 701 through a bus 711. When the I.FF 702 has been set, the level of the Q-output connected to the E-terminal of the D.C 701 becomes "1", and count-down is started. The data transferred to the D.C. 701 is counted down by means of 8 μs-clock pulse supplied from the timer section 72 until the level thereof becomes "0" (the level of the ZD-terminal is "1").

Figure 7B:
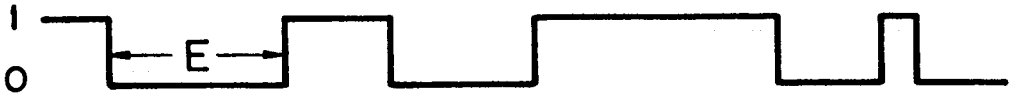

When the level of the zero-detect (ZD) terminal of the D.C 701 has become "1", the "1"-level is delivered to the R-terminal of the I.FF 702, and the I.FF 702 is reset (The Q-output level is "0" and the $\overline{Q}$-output level is "1"). At the same time, the level of the E-terminal of the D.C 701 becomes "0" again, terminating the count-down. Accordingly, the $\overline{Q}$-output signal (the injector-valve-opening-drive signal) of the I.FF 702 becomes as shown in FIG. 7B.

The $\overline{Q}$-output of the I.FF 702 is connected through a resistor to a first-stage transistor 731 in a power-amplifying circuit 730, and the emitter of this transistor is connected to transistors 732 and 733 which constitute a pair of Darlington transistors. The collector of the transistor 733 is connected through an output terminal 723 to one terminal of the drive coils of the six injectors 5. The other terminal of the drive coils is connected through a resistor to the plus side ($V_B$) of the battery.

Accordingly, while the level of the $\overline{Q}$-output of the I.FF 702 remains "0", the level of all the transistors 731 to 733 is in the ON condition, and a current flows through the drive coils of the injectors 5, causing the valves of the injectors 5 to be opened. That is, as shown in FIGS. 7A and 7B, the injectors 5 start injection each time an IG pulse is generated, computation being performed by the CPU 70 and fuel being injected for a period corresponding to the injection-time data E set in the I.R 700.

Figure 6:
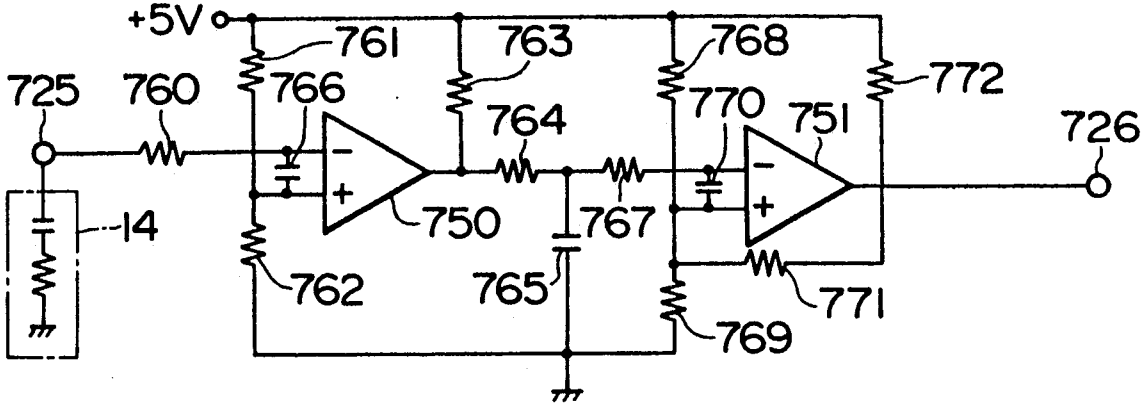
FIG. 6 is a detailed circuit diagram of the input-interface section.
Figure 7C:
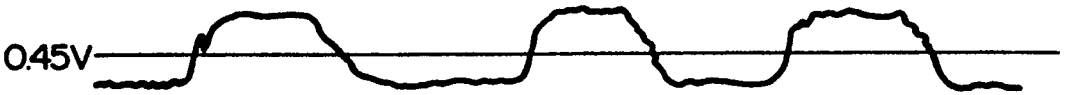
FIGS. 7C and 7D are timing charts illustrating the circuit operation in the interface section shown in FIG. 6.
Figure 7D:
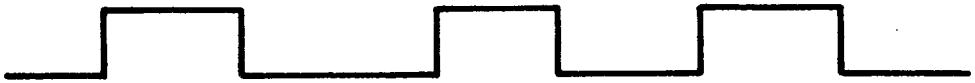

FIG. 6 is a detailed circuit diagram of an air-fuel-ratio-sensor input circuit, which is a component of the input-interface section 74. In the following, the operation of this input circuit will be described with reference to the timing charts of FIGS. 7C and 7D. The output voltage (FIG. 7C) of the air-fuel-ratio sensor 14 (which, in this embodiment, mainly consists of $ZrO_2$) is connected through an input terminal 725 and a resistor 760 to the inverting input terminal (−) of a comparator 750. The voltage level of the non-inverting input terminal (+) of the comparator 750 is fixed to 0.45 V by means of voltage-dividing resistors 761 and 762. Thus, when the output voltage of the air-fuel-ratio sensor 14 is lower than 0.45 V (lean), the level of the output of the comparator 750 is "1", and, when the output voltage is higher than 0.45 V (rich), the level of the output is "0". The output of the comparator 750 is supplied through resistors 764 and 767 to the inverting input terminal of a second comparator 751. The resistor 764 forms, along with a capacitor 765, an integrating circuit used when the air-fuel ratio is turned from lean to rich. The resistors 763 and 764 form, along with the capacitor 765, an integrating circuit used the air-fuel ratio is turned from rich to lean. These integrating circuits serve to correct any dispersion in air-fuel ratio between the cylinders as well as any chattering of the output signal of the air-fuel-ratio sensor caused by the ignition noise or the like. The non-inverting input terminal of the comparator 751 receives, like the first comparator 750, a reference numeral of about 0.45 V. This reference voltage is likewise obtained by means of voltage-dividing resistors 768 and 759. Because of the presence of a positive feedback resistor 771, the value of this reference voltage is somewhat larger than 0.45 V when the output level of the comparator 751 is "1", and is somewhat smaller than 0.45 V when the output level is "0". Because of the hysteresis provided in the comparator 751, the output level of this comparator is "0" when the output level of the comparator 750 is "1" (lean), and is "1" when the output level of the comparator 750 is "0" (rich). Thus, in correspondence with the output voltage signal of the air-fuel-ratio sensor shown in FIG. 7C, the output level of the comparator 751 is "0" under the "lean" condition, and "1" under the "lean" condition, and "1" under the "rich" condition, as shown in FIG. 7D. The output of the comparator 751 is connected through a terminal 726 to the input port of the CPU 70, and, the CPU calculates the feedback control quantity of the air-fuel ratio by accessing this input port every certain period through the timer interrupt described below.

Next, the program stored in the ROM 75 will be described in detail. The program may be divided into three hierarchical classes: a main routine, a timer-interrupt-processing program, and an injection-interrupt program, which will be described one by one. The main routine is a program of the lower dispatching priority. When the interrupt of either of the other two occurs during the execution of the main routine, priority is given to the other program, the main routine being temporarily suspended to be started again after the termination of the interrupt program.

Figure 8:
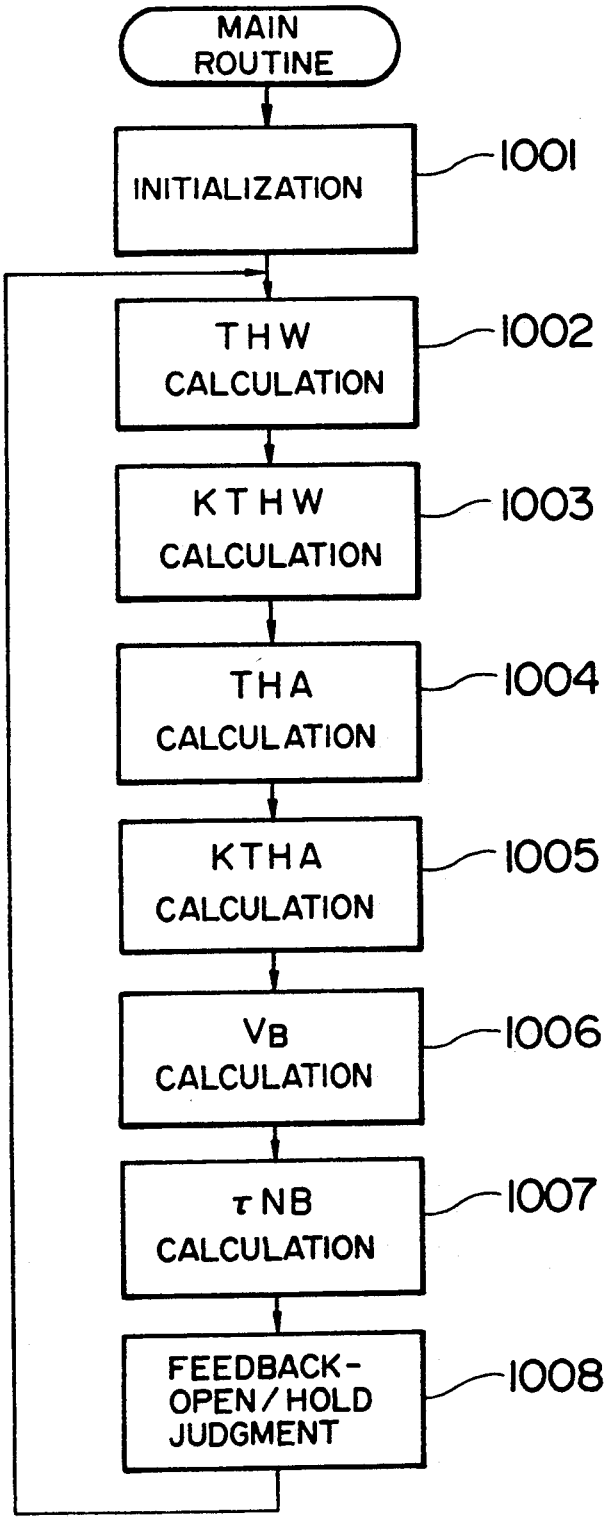
FIG. 8 is a flowchart showing the main routine for the ROM shown in FIG. 4.

Next, the processing of the main routine will be illustrated with reference to FIG. 8. The main routine is started by turning on the power of the control circuit 20. First, in Step 1001, initialization is executed. By this initialization, the control circuit 20 is initialized; the RAM 76 is cleared, the initial data is set, interrupt is enabled, and so on. Next, the procedure moves to Step 1002, where the engine coolant temperature THW is calculated on the basis of a signal supplied from the water-temperature sensor 13. In Step 1003, the coolant temperature quantitative coefficient $K_{THW}$ is obtained by a well-known method. Likewise, the intake-air temperature THA is obtained in Step 1004 on the basis of a signal from the intake-air-temperature sensor 12, and, in Step 1005, the intake-air-temperature correction coefficient $K_{THA}$ is calculated. Next, in Step 1006, the battery voltage $V_B$ is calculated from a signal supplied from the battery 16-1. In Step 1007, the invalid-injection time $\tau_{NB}$ is calculated from $V_B$. $\tau_{NB}$ is obtained by the following equation:

$$\tau_{NB} = -C_1 V_B + C_2 \quad (1)$$

($\tau_{NB} \geqq C_3$; $C_1$, $C_2$ and $C_3$ are constants.)

Next, in Step 1008, a judgment is made as to whether or not a condition has been established for the air-fuel-ratio sensor 14 which makes the air-fuel-ratio feedback control "open" (stop) (e.g., the coolant temperature and the engine speed) and as to whether or not a condition has been established which makes it "hold" (keep) (e.g., whether or not the fuel-injection has been stopped, i.e., whether or not the fuel cut is being effected). Afterwards, the procedure returns to Step 1002 to repeat the above processing.

Figure 9:
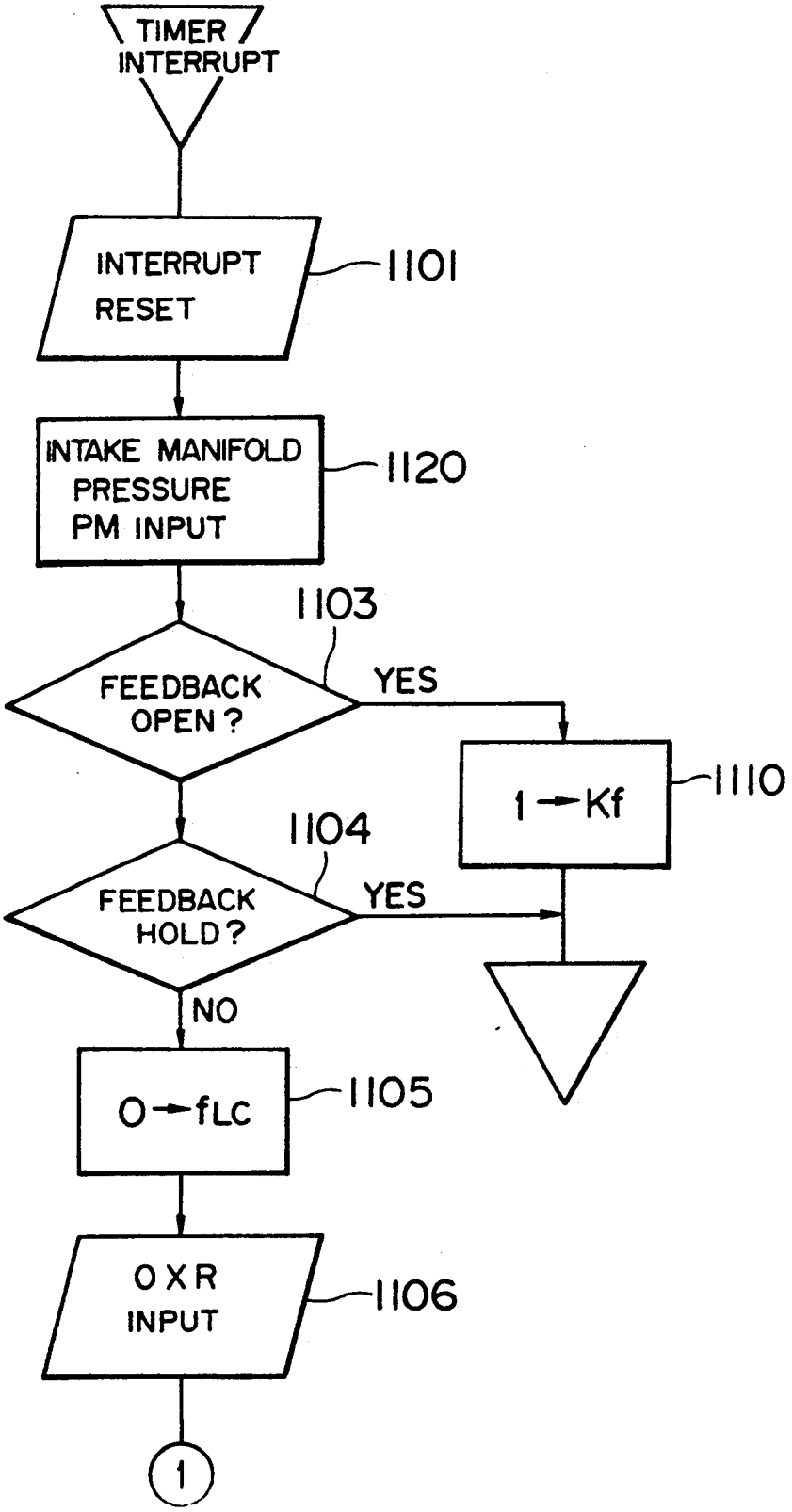
FIGS. 9, 10A, 10B and 11 are flow charts showing the operations of the CPU shown in FIG. 4.

Next, the timer interrupt, which is of the highest dispatching priority next to the injection interrupt, will be described with reference to FIGS. 9 to 11. This interrupt is started every certain period (e.g., 8 ms) on the basis of a signal from the timer section 72. When the injection-interrupt program, which is to be performed in accordance with an interrupt-request signal from the interrupt-control section 73, is not being executed, the processing of Step 1101 is executed immediately, and, when the injection-interrupt program is being executed, the proccessing of Step 1101 is executed after the program has been terminated, resrtting the timer-request interrupt signal. Next, the procedure moves on to Step 1102, where the intake manifold pressure PM is calculated on the basis of a signal from the pressure sensor 11. When the feedback has been judged to be "open" in the above-described main routine, the judgment in Step 1103 is YES, and the procedure moves on to Step 110, where a feedback coefficient $K_f$ as the feedback-control quantity is set to 1. When the feedback has been judged to be "hold", YES-judgment is made in Step 104, terminating the interrupt processing while keeping the $K_f$ on the previous level.

Next, in Step 1105, a flag for judging a transient state (e.g., acceleration or deceleration) is reset, establishing the condition: $f_{LC}=0$. In Step 1106, the input signal from the air-fuel-ratio sensor 14, transformed into a logical signal through the above-mentioned air-fuel-ratio-sensor input circuit shown in FIG. 6 and supplied to the input port of the CPU 70, is entered into the CPU 70, and is stored in OXR. Inside the CPU 70, the "lean" condition corresponds to "0", and the "rich" condition corresponds to "1", as shown in FIGS. 7C and 7D.

Figure 10A:
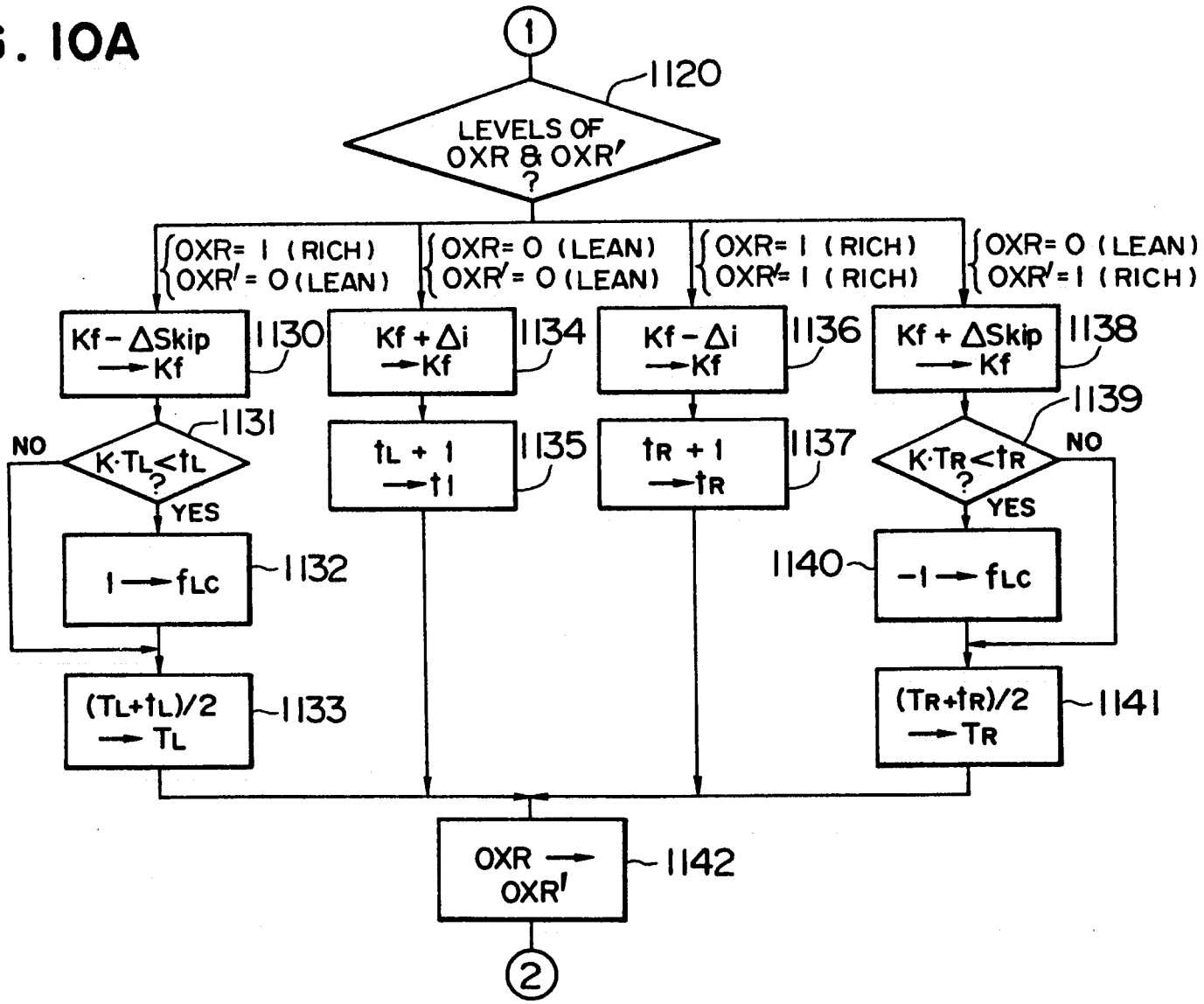

Next, the procedure moves on to the condition-judging step, Step 1120, shown in FIG. 10A. In this step, the procedure is divided into a number of steps in accordance with the OXR value stored in Step 1106 and the OXR value 8 ms prior to that (OXR'). First, when OXR=1 (rich) and OXR'=0 (lean), i.e., when the signal from the air-fuel-ratio sensor 14 has been turned from lean to rich, the processing of Steps 1130 to 1133 are executed.

First, in Step 1130, the feedback coefficient $K_f$ is decreased by ΔSkip as the feedback-control quantity, as in the normal feedback control. That is, the calculation of the following equation (2) is executed to obtain the proportional of the coefficient $K_f$:

$$K_f = K_f - \Delta Skip \quad (2)$$

Next, in Step 1131, the time obtained by multiplying the average $T_L$ of the lean-continuation times in the past by K is compared with the lean-continuation time $t_L$ before the turning of the air-fuel ratio from lean to rich. That is, during a transient period (e.g., acceleration), the lean-condition time is longer than the set value of the average in the past (K $T_L < t_L$) The judgment flag $f_{LC}$ is then set to "1" in Step 1132 so as to increment the fuel correction value described below. When the lean-condition time is shorter than the set value, Step 1132 is skipped over. Next, in Step 1133, the following equation (3) is executed in order to average the lean-condition time $t_L$ obtained this time:

$$T_L = (T_L + t_L)/2 \quad (3)$$

When OXR=0 (lean) and OXR'=1 (rich), that is, when the air-fuel ratio has been turned from rich to lean, the processing of Steps 1138 to 1141 are executed. In Step 1148, the feedback coefficient $K_f$ is increased by ΔSkip. That is, the proportional of the feedback coefficient $K_f$ is calculated by the following equation (4):

$$K_f = K_f + \Delta Skip \quad (4)$$

Next, in Step 1139, the time obtained by multiplying the average $T_R$ of the rich-continuation time in the past by K is compared, as in Step 1131, with the rich-continuation time $t_R$ before the turning of the air-fuel ratio from rich to lean. During a transient period (e.g., deceleration), the rich-condition time is longer than the set value (K $T_R < t_R$), and the judgment flag $f_{LC}$ is set to "−1" in Step 1140 so as to decrease the fuel correction value to be described below. Next, in Step 1141, the following equation (5) is executed in order to average the rich-condition time $t_R$ obtained this time:

$$T_R = (T_R + t_R)/2 \quad (5)$$

When OXR=0 (lean) and OXR'=0 (lean), the processing of Steps 1134 and 1135 are executed. In Step 1134, an integration constant Δi is added to the feedback coefficient $K_f$. That is, the integration term of the coefficient $K_f$ is calculated by executing the following equation (6):

$$K_f = K_f + \Delta i \quad (6)$$

In Step 1135, an increase by "1" is effected in order to count the lean-continuation time $t_L$.

When OXR=1 (rich) and OXR'=1 (rich), the processing of Steps 1135 and 1137 are executed. In Step 1136, the integration coefficient Δi is subtracted from the feedback coefficient $K_f$. That is, the following equation (7) is executed:

$$K_f = K_f - \Delta i \quad (7)$$

In Step 1137, an increase by "1" is effected in order to count the rich-continuation time $t_R$.

When the above processings have been terminated, transition is effected, in Step 1142, to to the current signals OXR and OXR' of the air-fuel-ratio sensor 14.

This method is practised in order to determine the flag $f_{LC}$ for effecting correction by comparing the lean-condition time and rich-condition time during a transient period with the feedback period prior to that.

Figure 10B:
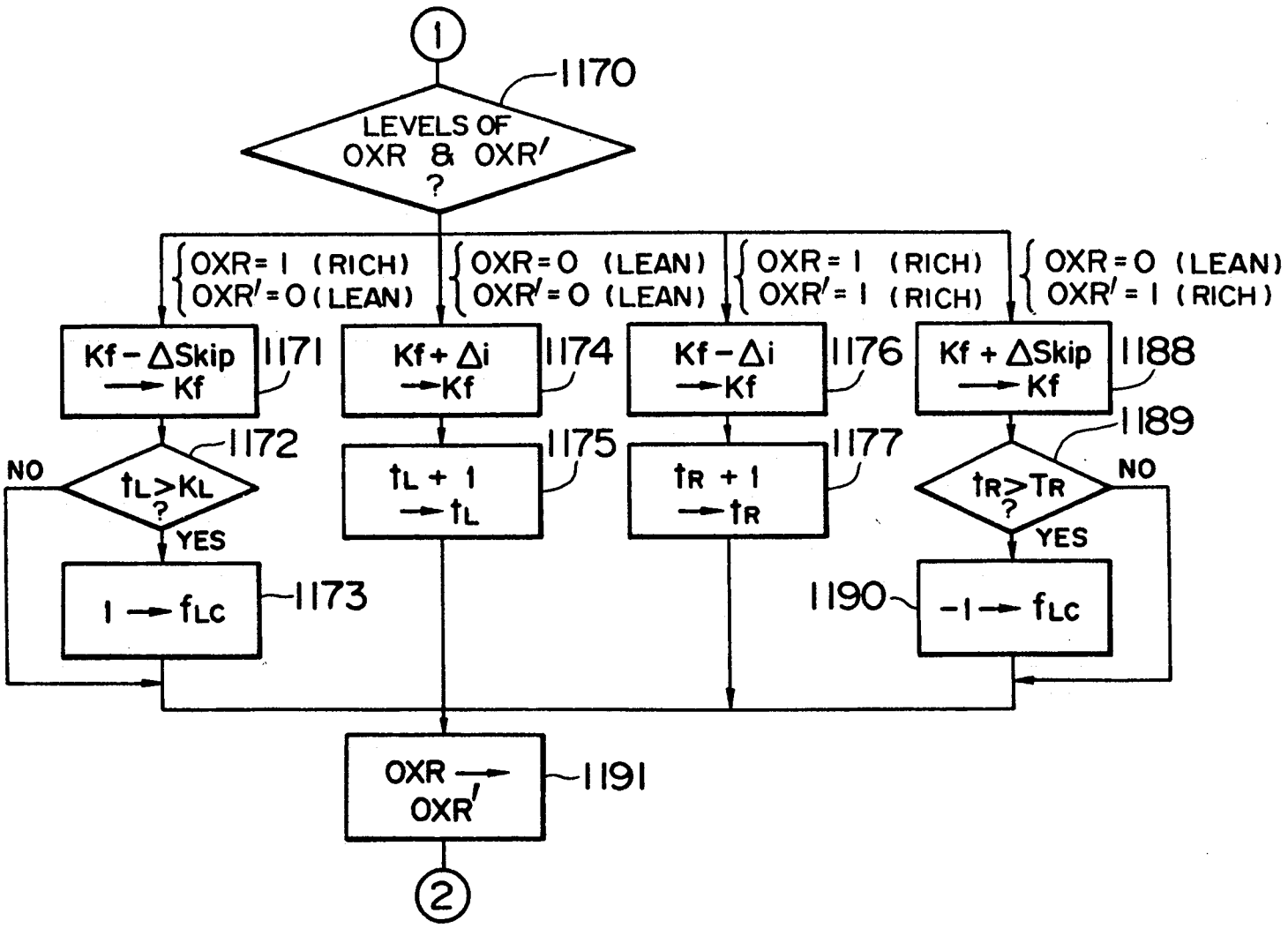

According to another method shown in FIG. 10B, the flag $f_{LC}$ for effecting correction is determined by comparing the lean-condition time and rich-condition time during a transient period with an arbitrarily set time. As in the method shown in FIG. 10A, changes in the air-fuel-ratio sensor 14 is detected in Step 1170. In the case of turning from the lean to the rich condition, setting is made in Step 1171 as: $K_f - \Delta Skip \rightarrow K_f$. When, in Step 1172, the lean-continuation time $t_L$ is longer than a predetermined value $K_L$, the engine is judged to be in a transient state (e.g., acceleration), and the procedure moves on to Step 1173, setting the flag $f_{LC}$ to "1" so as to increase the fuel quantity. When turning from the rich to the lean condition, the procedure moves from Step 1170 to Step 1188, and setting is effected in Step 1189 as: $K_f + \Delta Skip \rightarrow K_f$. When, in Step 1189, the rich-continuation time $t_R$ is longer than a predetermined value $K_R$, the engine is judged to be in a transient state (e.g., deceleration), and the procedure moves on to Step 1190, the flag $f_{LC}$ being set to "−1" so as to effect reduction in fuel quantity. As to the states in which no change occurs in the air-fuel ratio, that is, Steps 1174 to 1177 and Step 1191 are the same as the Steps 1134 to 1137 and Step 1142 in FIG. 10A, so that an explanation thereof will be omitted.

Next, the procedure of obtaining a transient correction coefficient $K_{TR}$ and procedure of obtaining a transient learning value $K_G$ for correcting the transient correction coefficient $K_{TR}$ in accordance with the condition of the transient-state judging flag $f_{LC}$ will be explained with reference to FIG. 11.

First, in Step 1150, the pressure variate: ΔPM=PM−PM' is obtained. Here, PM' represents the inlet-pipe pressure 24 ms before, and PM represents the current inlet-pipe pressure. Next, in Step 1151, transient-state judgment is made. When |ΔPM| is smaller than a predetermined value, the engine is considered to be in the steady state and the procedure is returned. When |ΔPM| is larger than the predetermined value, the engine is considered to be in a transient state (acceleration), and the procedure moves on to Step 1152, where the transient learning value $K_G$ is calculated. More specifically, the following processings are executed in Step 1152: first, the value of a gasoline-correction fundamental function f (THW) is obtained from the current coolant temperature. The value obtained is multiplied by a gasoline learning coefficient a. Then, by adding to the resulting value a deposit learning value b=b (THW) which is determined in correspondence with the coolant temperature THW, the transient learning value $K_G$ is obtained (The deposit learning value is $b_1$ when the coolant temperature is less than 60° C., $b_2$ when it is in the range of 60° C. to 80° C., and 0 when it is more than 80° C.).

Figure 12:
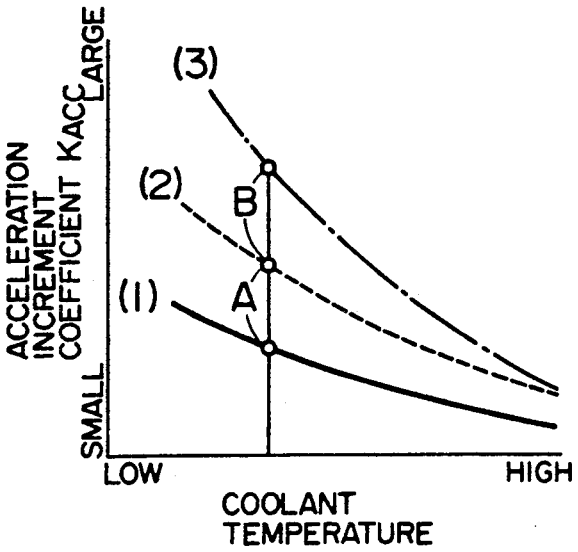
FIG. 12 is a characteristic diagram showing the changes in the fuel-increment coefficient allowing an air-fuel ratio under acceleration condition to be adjusted to the theoretical air-fuel ratio; the fuel-increment coefficient was measured for different gasolines and different deposit quantities around the intake valve.

The reason for determining the transient learning value $K_G$ by the equation:

$$KG=a\times f(THW)+b$$

is as follows:

FIG. 12 shows how the acceleration increment coefficient $K_{ACC}$ making the air-fuel ratio during the acceleration period equal to the theoretical air-fuel ratio changes with the temperature of the coolant. Here, the acceleration increment coefficient was measured for different gasolines and different deposit amounts around the intake valve.

Curve (1) of FIG. 12 represents the acceleration increment coefficient of an engine having no valve deposit and using a regular gasoline. This constitutes the base adaptation constant $K_{BA}$ of the acceleration increment. Curve (2) represents the characteristic of the case where the same engine uses a gasoline with poor volatility. Curve (3) represents the case where this gasoline with poor volatility is used in an engine having valve deposit.

Thus, the difference A between Curves (1) and (2) represents the increment coefficient due to the difference in gasoline properties, and the difference B between Curves (2) and (3) represents the increment coefficient due to the valve deposit.

The above A and B may be approximated as:

$$A=a\times f(THW)$$

$$B=b_1, b_2, \ldots, b_n$$

where, a: gasoline learning coefficient (Its value can be updated through learning but exhibits a uniform value with respect to the coolant temperature.)

f(THW): function of the coolant temperature THW (This constitutes a gasoline-correction fundamental function for correcting the influence of the gasoline and is previously stored in the program.)

$b_1, b_2, \ldots, b_n$ deposit learning value (This is a learning value for correcting the influence of the deposit and is established for each water-temperature range.)

By appropriately selecting the gasoline-correction fundamental function f(THW), transient correction can be effected solely by changing the gasoline learning coefficient a in accordance with the type of gasoline (i.e., solely by changing the constant which is uniform with respect to the coolant temperature).

Figure 13:
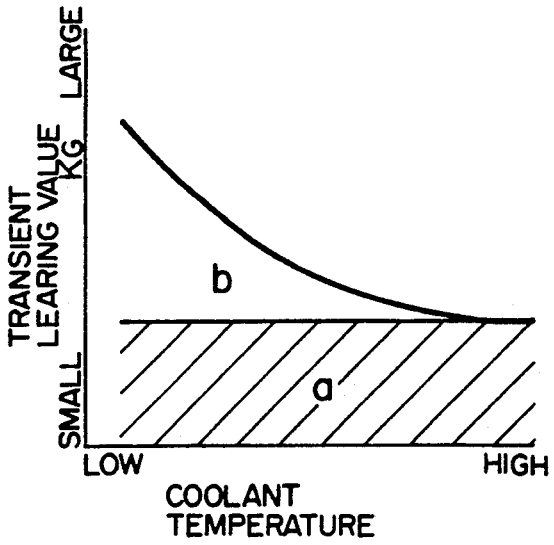
FIG. 13 is a characteristic diagram showing the relationship between the transient learning value of this invention and the coolant temperature.

Thus, as shown in FIG. 13, the transient learning value $K_G$ can be expressed as the sum of the learning coefficient a (for gasoline correction) which remains uniform with respect to the coolant temperature and the learning value b (for deposit correction) which depends upon the coolant temperature.

Thanks to this arrangement, learning can be performed in any coolant temperature range for the gasoline properties, which change relatively early, so that, even if the temperature has risen quickly and the engine warm-up has been completed soon, a sufficient learning chance is available. On the other hand, the learning speed need not be so high for the intake-valve deposit since deposit is produced quite slowly. Accordingly, providing different deposit-correction learning values b for different coolant temperature ranges results in reduction in the learning frequency. However, since a high learning speed is not required there, there is a sufficient chance for correction. Thus, the learning coefficient a and the learning value b are learned, and the transient learning value is determined in the form: $a\times f(THW)+b$ to reflect it in the transient correction values such as the acceleration increment coefficient $K_{ACC}$, thereby making it possible to speedily correct the air-fuel ratio of a mixture in a transient state to an appropriate value.

Figure 11:
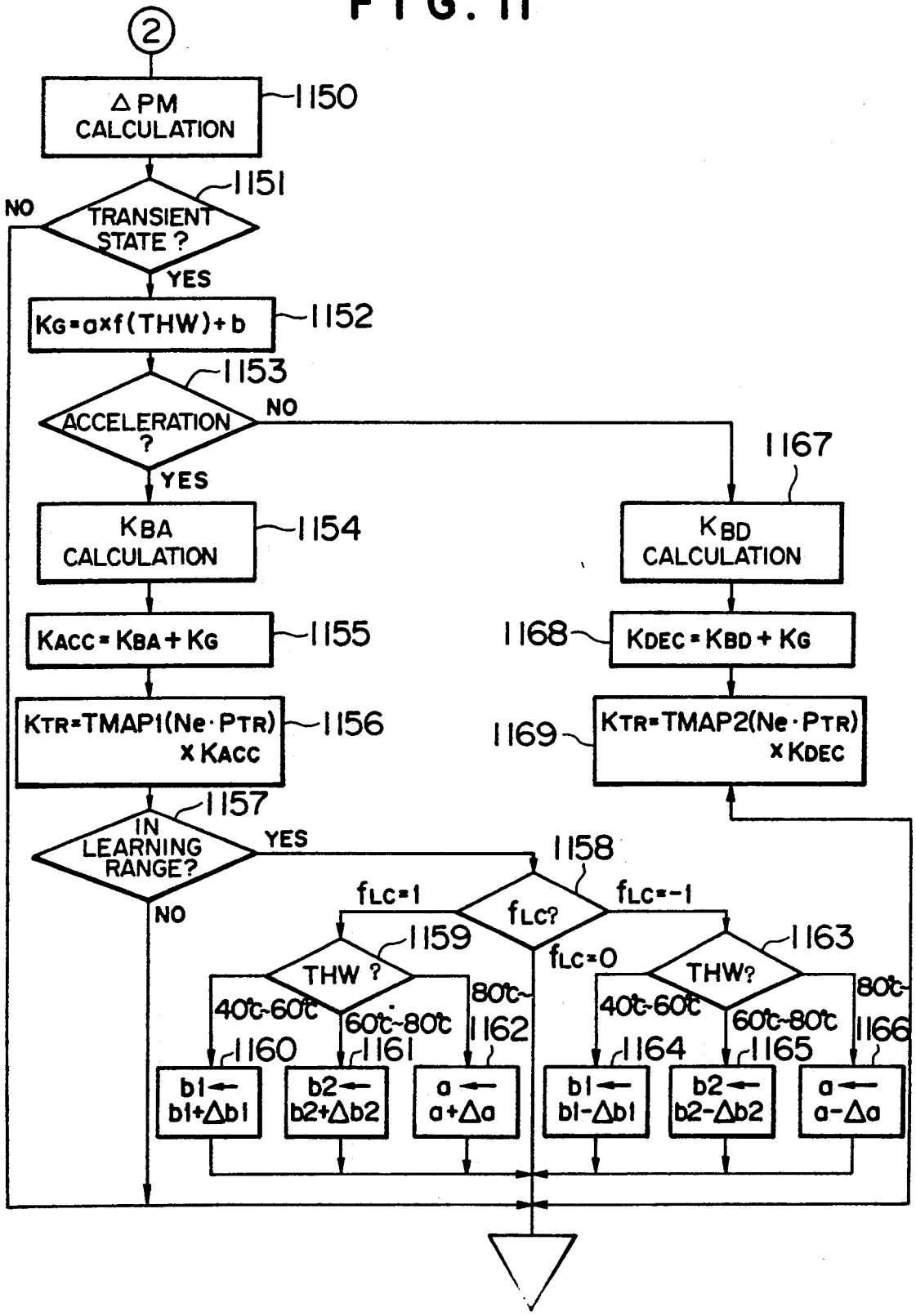

Thus, in the processings shown in FIG. 11, the transient learning value $K_G$ is obtained on the basis of the above-described idea, and the updating of the gasoline learning coefficient a and the deposit learning value b, etc. are effected.

Referring again to FIG. 11, a judgment is made in Step 1153 as to whether this transient state is acceleration or deceleration. If $\Delta PM>0$, it is judged to be acceleration, and the procedure moves on to Step 1154. If $\Delta PM<0$, it is judged to be deceleration, the procedure moving on to Step 1167.

In Step 1154, the base acceleration increment coefficient $K_{BA}$ is calculated. This $K_{BA}$ is a constant which is previously adapted to each coolant temperature. Subsequently, in Step 1155, the acceleration increment coefficient $K_{ACC}=K_{BA}+K_G$ is calculated. Then, in Step 1156, the final transient correction coefficient $K_{TR}$ is obtained. This $K_{TR}$ is obtained as the product of the two-dimensional map TMAP1 ($N_e$, $P_{TR}$) of the engine speed $N_e$ and the absolute value $|\Delta PM|$ of the pressure variate $\Delta PM$ (hereinafter referred to as $P_{TR}$ indicating a pressure variation in a transient state) and the acceleration increment coefficient $K_{ACC}$.

Next, in Step 1157, an examination is made as to whether or not the engine condition is currently in the learning range. That is, referring to FIG. 14 which shows the learning ranges, whether or not the coolant temperature is in the range of 40° to 100° C. is examined. Even when the coolant is in this range, the engine condition is regarded to be out of the learning range if the air-fuel-ratio sensor 14 has not yet been activated or if there has been a large quantity of increment after the engine start. Alternate routing is then made for all the subsequent processings.

Next, in Step 1158, the transient-condition judging flag $f_{LC}$ is examined. When $f_{LC}=1$, the lean condition has been continued long. In that case, the procedure moves on to Step 1159 in order to increase the acceleration-increment transient learning value $K_G$.

From Step 1159, the procedure moves on to any one of Steps 1160 to 1162 in accordance with the current coolant temperature, increasing any one of the values: the learning coefficient a and the learning values $b_1$, $b_2$. That is, when, in FIG. 14, the coolant temperature it is in the range of 40° to 60° C., $b_1$ is increased, and, when it is in the range of 60° to 80° C., $b_2$ is increased. When the coolant temperature is in the range of 80° to 100° C., a is increased. Here, it is desirable that the correction amount $\Delta a$, $\Delta b_1$ or $\Delta b_2$ be smaller on the lower coolant temperature side. That is, the condition: $\Delta b_1 \leqq \Delta b_2 < \Delta a$ be established. This is due to the fact that the coolant temperature changes from the lower to the higher side. Accordingly, an excessive correction amount on the lower-temperature side results in the amount that should be learned on the higher-temperature side being learned extra on the lower-temperature side. This would result in an excessive learning on the lower-temperature side. In this embodiment, in particular, the learning on the lower-temperature side is classified as the correction for those factors changing relatively slowly, for example, the valve deposit, so that the learning on the lower-temperature side can be slowed down.

When, in Step 1158, $f_{LC}=-1$, the rich condition has been continued long, so that the procedure moves, by way of Step 1163, to any one of Steps 1164 to 1166 in order to decrease the transient learning value $K_G$. In the case where $f_{LC}=0$, the transient learning value $K_G$ is not corrected.

When the engine is judged not to be in the accelerating but in the decelerating state in Step 1153, a base deceleration decrement coefficient $K_{BD}$ is calculated in Step 1167. This $K_{BD}$ is an adaptation constant which is determined in accordance with the coolant temperature THW. Next, in Step 1168, a deceleration decrement coefficient $K_{DEC}=K_{BD}+K_G$ is calculated. Next, in Step 1169, the transient correction coefficient $K_{TR}$ is obtained as the product of the two-dimensional map TMAP2 ($N_e$, $P_{TR}$) for deceleration and the deceleration decrement coefficient $K_{DEC}$.

With the above processing, the timer interrupt is completed.

Figure 14:
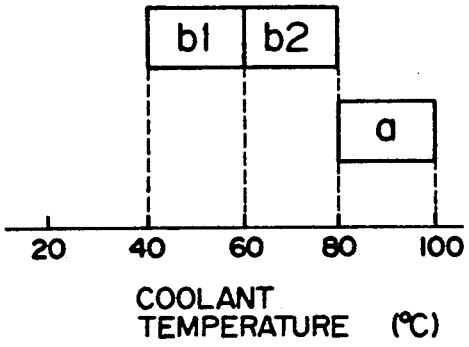
FIG. 14 is a diagram showing the learning range in accordance with the air-fuel-ratio controlling method of this invention.
Figure 15:
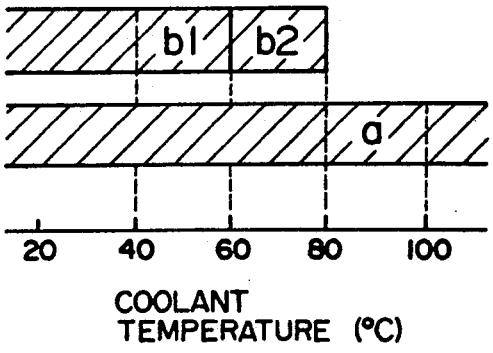
FIG. 15 is a diagram showing the reflection range in accordance with the air-fuel-ratio controlling method of this invention.

In accordance with the processing of FIG. 11 described above, the gasoline learning coefficient a related to the gasoline properties is updated only in the temperature range of 80° to 100° C., and the deposit learning values $b_1$ and $b_2$ are updated in the temperature ranges of 40° to 60° C. and 60° to 80° C., respectively, as shown in FIG. 14. As shown in FIG. 15, the gasoline learning coefficient a is used to calculate the transient learning value $K_G$ over the entire coolant temperature range, whereas the deposit learning values $b_1$ and $b_2$ are used to calculate the transient learning value $K_G$ in the coolant temperature ranges of less than 60° C. and 60° to 80° C., respectively.

Figure 16:
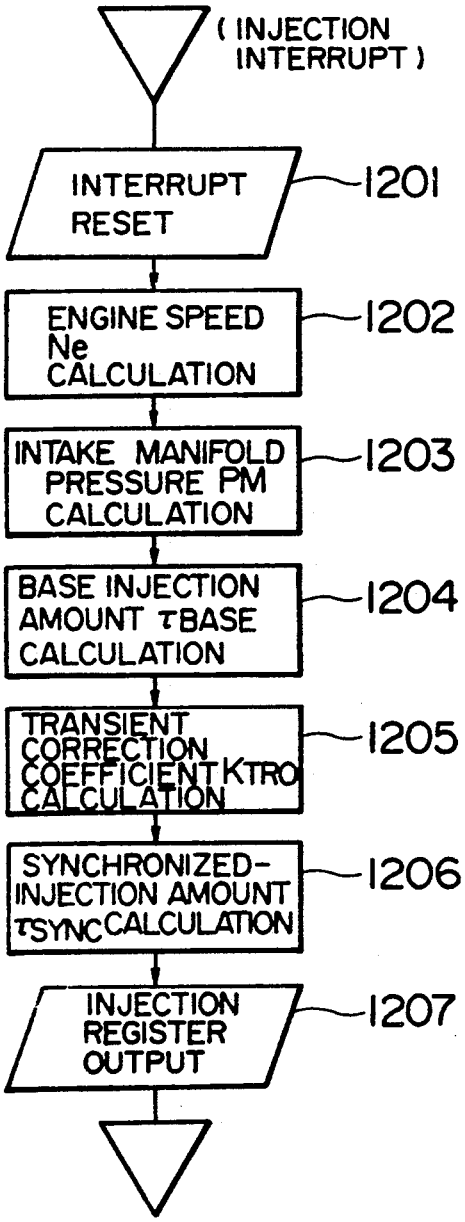
FIG. 16 is a flow chart showing the injection-interrupt processing in the air-fuel-ratio controlling method of this invention.

Next, the injection interrupt will be described with reference to FIG. 16. The injection interrupt is an interrupt of the highest priority; if an injection-interrupt-request signal is generated by an IG-signal supplied from the rotation sensor 15, the injection-interrupt program is executed, suspending any other program, such as the main routine or the timer interrupt, which happens to be being executed. While the injection-interrupt program is being executed, no other interrupt-request signal causes the processing to be suspended. First, in Step 1201, the injection-interrupt-request signal is released. Then, the procedure moves on to Step 1202 to calculate the engine speed $N_e$. After measuring the time width $T_{IG}$ between adjacent IG-pulse signals by means of the timer section 72, the engine speed $N_e$ is obtained by the following equation (9):

$$N_e=K_{IG}/T_{IG} \tag{9}$$

where $K_{IG}$: constant (which is to be determined in accordance with the number of cylinders and the frequency of the measurement clock signal).

Next, in Step 1203, the intake manifold pressure PM is calculated on the basis of a signal supplied from the pressure sensor 11. A base injection amount $\tau_{BASE}$ is obtained, in Step 1204, from the $N_e$ and the PM through interpolation of the two-dimensional map of ($N_e$, PM).

Next, in Step 1205, a correction coefficient $K_{TRO}$ included in the injection amount $\tau_{SYNC}$ is calculated in the injection amount $\tau_{sync}$ is calculated from the transient correction coefficient $K_{TR}$ obtained through the timer interrupt. That is, while normally $K_{TRO}=K_{TR}$, when $K_{TRO}>0$, that is, during acceleration increment, a decrement by $\Delta K_{TRO}$ for each ignition (one-ignition decrement) is effected until the condition: $K_{TRO}=0$ is attained.

Next, in Step 1206, the synchronized-injection amount $\tau_{sync}$ is calculated by, for example, the following equation (10):

$$\tau SYNC=K_{THW}\times K_{THA}\times K_f\times(1+K_{TRO})\times\tau_{BASE}+\tau_{NB} \tag{10}$$

where $K_{THW}$: coolant temperature correction coefficient $K_{THA}$: intake-air-temperature correction coefficient $K_f$: air-fuel-ratio-sensor-feedback coefficient $\tau_{NB}$: invalid-injection time $K_{TRO}$: transient correction coefficient Next, in Step 1207, in response to a setting command from CPU 70, which is applied to the terminal 721, a calculation-injection register 700 is set. When the processing of injection interrupt has been completed, either of the main routine or the timer interrupt processing, which happend to have been suspended, is resumed.

With this, the processing in accordance with the programs is completed.

While in the above embodiment the learning coefficient a and the learning values $b_1$, $b_2$ are updated only when accelerating the engine, the updating can also be effected when decrlerating it. In that case, it is more desirable that different learning coefficients and different learning values be prepared for acceleration and deceleration.

Further, while the above embodiment has been described solely on the basis of the that the influence of the coolant temperature varies depending on the type of factor causing variation in air-fuel ratio, it should be noted, to be more precise, that the influence of the temperature around the intake valve on which gasoline is splashed and the influence of the temperature in the combustion chamber also vary depending on the type of factor causing variation in air-fuel ratio. Accordingly, it is more preferable to divide the learning range in accordance with these temperatures. To practise this, the integrated value of, for example, the gasoline-injection amounts, may be used instead of the coolant temperature. Since the amount of heat generated by the gasoline per unit weight is fixed, the total amount of generated heat imparted to the engine can be known from the total amount of fuel injected. Thus, instead of the coolant temperature THW, the integrated value $\Sigma P$ of the injection amount (which can be represented by, for example, the injection-pulse width). In that case, $F(\Sigma P)$ and $b=b(\Sigma P)$ take the place of f(THW) and b=b(THW), respectively.

While in the above description the transient learning value $K_G$ is given in the form: $a\times f(THW)+b$, the condition: $f(THW)=c$ (which remains constant regardless of the coolant temperature) may be established in some special cases by appropriately setting the base acceleration increment coefficient $K_{BA}$, the base deceleration decrement coefficient $K_{BD}$, and the two-dimensional maps of the engine speed $N_e$ and the pressure change $P_{TR}$ (TMAP 1 and TMAP 2). In such cases, $a\times c$ is replaced by a, resulting in a simple correction which is in the form: $a+b$.

Further, while in the above embodiment the respective learning speeds of the gasoline learning coefficient a and the deposit learning values $b_1$, $b_2$ are decreased on the lower-temperature side by setting relationship: $\Delta b_1 \leqq \Delta b_2 < \Delta a$, it is also possible to make the values of $\Delta b_1$, $\Delta b_2$ and $\Delta a$ equal to each other and to set the respective updating periods $Tb_1$, $Tb_2$ and Ta in the relationship: $Tb_1 \geqq Tb_2 > Ta$. More specifically, the deposit learning value $b_1$ may be obtained every F times the timer interrupt is performed, and the learning value $b_2$ every G times the timer interrupt is performed. The gasoline learning coefficient a may be obtained every H times the timer interrupt is effected (here, $F \geqq G > H$). In this way, the learning speed can be decreased.

While in the fuel injectors of this embodiment the intake manifold pressure sensor is used as the base intake-air-amount sensor, this invention can also be applied to an intake-air-amount sensor of the type in which the air amount is directly measured.

As described above, this invention has been made on the basis of the fact that the respective natures of factors causing variation in air-fuel ratio, such as the gasoline properties and the valve-deposit amount, differ greatly from one factor to the other in the switftness in variation and the dependence of the air-fuel ratio on the engine temperature. In accordance with this invention, the air-fuel ratio of a mixture is a transient state can be kept at a satisfactory value with accuracy over a wide engine-temperature range.

What is claimed is:

1. A method of controlling the air fuel ratio in internal combustion engines of the type in which a transient correction value for correcting a base fuel quantity in an internal combustion engine in a transient state is corrected in accordance with a transient learning value determined on the basis of a signal supplied from an air-fuel-ratio sensor when the engine is in a transient state, thereby accurately adjusting the air-fuel ratio of a mixture supplied to the engine in a transient state to a target air-fuel, said method comprising the steps of:

updating first learning terms at a first learning speed in response to a signal from said air-fuel-ratio sensor and respectively storing them in a reloadable memory device, said first learning terms being provided for respective different ranges corresponding to different engine temperatures and related to factors causing variation in air-fuel ratio in such a manner that the air-fuel-ratio variate of the variation varies depending upon the engine temperature;

updating second learning terms at a second learning speed which is higher than said first learning speed is response to a signal from said air-fuel-ratio sensor and storing them in said reloadable memory device, said second learning terms being related to factors causing variation in air-fuel ratio in such a manner that the air-fuel-ratio variate of the variation varies in a substantially uniform manner with respect to the engine temperature; and determining said transient learning value on the basis of said first learning terms dependent on the engine temperature and stored in said memory device and of said second learning terms stored in said memory device, and correcting said transient correction value in accordance with the transient learning value thus determined.

2. A method as claimed in claim 1, wherein said first learning terms are updated during the warm-up of the internal combustion engine, and wherein said second learning terms are updated after the warm-up of the internal combustion engine.

3. A method as claimed in claim 2, wherein said second learning terms are reflected in said transient correction value both during and after the warm-up of the internal combustion engine, said first learning terms being reflected in said transient correction value only during the warm-up of the internal combustion engine.

4. A method as claimed in claim 1, wherein said second learning speed is made higher than said first learning speed by adjusting the updating amount of said second learning terms to be larger than the updating amount of said first learning terms.

5. An apparatus for controlling the air-fuel ratio in internal combustion engines, comprising:

a base-injection-amount calculating means for calculating a base injection amount in accordance with the load condition of an internal combustion engine;

a transient-state detecting means for detecting a transient state of the internal combustion engine;

an air-fuel-ratio sensor adapted to measure the air-fuel ratio from the oxygen density in the exhaust gas of the internal combustion engine;

a transient-air-fuel-ratio controlling means adapted to correct a transient correction value for correcting said base injection amount when the internal combustion engine is in a transient condition in accordance with a transient learning value which is determined on the basis of a signal supplied from said air-fuel-ratio sensor and to adjust the air-fuel ratio of a mixture supplied to the internal combustion engine in a transient state to a target air-fuel ratio;

an engine-temperature-measuring means for measuring the temperature of the internal combustion engine;

a first-learning-term updating means adapted to update first learning terms provided for respective different ranges corresponding to different engine temperatures in response to a signal from said air-fuel-ratio sensor when the internal combustion engine is in a transient state and is being warmed up with its temperature being below a predetermined value;

a second-learning-term updating means adapted to update second learning terms in response to a signal supplied from said air-fuel-ratio sensor when the internal combustion engine is in a transient state and has been warmed up with its temperature being higher than the predetermined value; and a learning-value reflecting means adapted to reflect said second learning terms in said transient correction value both during and after the warm-up of the internal combustion engine and to reflect said first learning terms only during the warm-up of the internal combustion engine.

6. An apparatus as claimed in claim 5, wherein the speed at which said second learning terms are updated by said second-learning-term updating means is set higher than the speed at which said first learning terms are updated by said first-learning-term updating means.

7. An apparatus as claimed in claim 6, wherein the updating speed for said second learning terms is made higher than the updating speed for said first learning terms by setting the updating amount of said second learning terms larger than the updating amount of said first learning terms.

8. An apparatus for controlling the air-fuel ratio in internal combustion engines, comprising:

a base-injection-amount calculating means for calculating a base injection amount in accordance with the load condition of an internal combustion engine;

a transient-state detecting means for detecting a transient state of the internal combustion engine;

an air-fuel-ratio sensor for measuring the air-fuel ratio from the oxygen density in the exhaust gas of the internal combustion engine, a transient-air-fuel-ratio controlling means adapted to correct a transient correction value for correcting said base injection amount when the internal combustion engine is in a transient condition in accordance with a transient learning value which is determined on the basis of a signal supplied from said air-fuel-ratio sensor and to adjust the air-fuel ratio of a mixture supplied to the internal combustion engine in a transient state to a target air-fuel ratio;

an engine-temperature-measuring means for measuring the temperature of the internal combustion engine;

a first-learning-term updating means adapted to update, at a first learning speed, first learning terms provided for respective different ranges corresponding to different engine temperatures in response to a signal supplied from said air-fuel-ratio sensor when the internal combustion engine is in a transient state;

a second-learning-term updating means adpated to update second learning terms in response to a signal supplied from said air-fuel-ratio sensor when the internal combustion engine is in a transient state at a second learning speed which is higher than said first learning speed; and a learning-value reflecting means adapted to reflect said second learning terms in said transient correction value irrespective of the engine temperature and to reflect said first learning terms only in the range corresponding to the engine temperature at that time.

9. An apparatus as claimed in claim 8, wherein the learning speed for said second learning terms is made higher than the learning speed for said first learning terms by setting the updating amount of said second learning terms larger than the updating amount of said first learning terms.

* * * * *